US007810471B2

(12) United States Patent
Zdroik

(10) Patent No.: US 7,810,471 B2
(45) Date of Patent: Oct. 12, 2010

(54) TWO-PIECE INJECTOR CUP AND METHOD OF MANUFACTURING SAME

(75) Inventor: Michael J. Zdroik, Metamora, MI (US)

(73) Assignee: Millennium Industries, Auburn Hills, MI (US)

( * ) Notice: Subject to any disclaimer, the term of this patent is extended or adjusted under 35 U.S.C. 154(b) by 107 days.

(21) Appl. No.: 12/353,594

(22) Filed: Jan. 14, 2009

(65) Prior Publication Data

US 2009/0178650 A1 Jul. 16, 2009

Related U.S. Application Data

(60) Provisional application No. 61/020,834, filed on Jan. 14, 2008.

(51) Int. Cl.
*F02M 55/02* (2006.01)

(52) U.S. Cl. ..... 123/456; 123/468; 123/470

(58) Field of Classification Search ..... 123/456, 123/468, 469, 470; 285/21.1, 133.5, 133.6
See application file for complete search history.

(56) References Cited

U.S. PATENT DOCUMENTS

| | | | | |
|---|---|---|---|---|
| 4,519,368 | A * | 5/1985 | Hudson, Jr. | 123/468 |
| 4,570,600 | A * | 2/1986 | Atkins et al. | 123/468 |
| 5,024,198 | A * | 6/1991 | Usui | 123/468 |
| 5,035,224 | A * | 7/1991 | Hornby et al. | 123/470 |
| 5,724,946 | A * | 3/1998 | Franchitto | 123/470 |
| 6,019,089 | A * | 2/2000 | Taylor et al. | 123/470 |
| 6,481,420 | B1 * | 11/2002 | Panasuk et al. | 123/470 |
| 6,736,111 | B2 * | 5/2004 | Braun et al. | 123/456 |
| 6,871,637 | B2 * | 3/2005 | Tsuchiya et al. | 123/467 |
| 6,874,477 | B1 * | 4/2005 | Lorraine et al. | 123/468 |
| 6,892,704 | B2 * | 5/2005 | Tsuchiya et al. | 123/456 |
| 6,959,695 | B2 * | 11/2005 | Warner et al. | 123/456 |
| 7,107,969 | B2 * | 9/2006 | Norcutt et al. | 123/470 |
| 7,159,570 | B2 * | 1/2007 | Zdroik | 123/470 |
| 7,455,050 | B2 * | 11/2008 | Xu | 123/468 |
| 7,556,022 | B1 * | 7/2009 | Doherty et al. | 123/470 |
| 7,584,746 | B1 * | 9/2009 | Furchill et al. | 123/456 |
| 2009/0084358 | A1 * | 4/2009 | Zdroik | 123/470 |
| 2010/0012093 | A1 * | 1/2010 | Pepperine et al. | 123/470 |

* cited by examiner

*Primary Examiner*—Thomas N Moulis
(74) *Attorney, Agent, or Firm*—Dykema Gossett PLLC

(57) ABSTRACT

A fuel delivery system comprises a fuel rail having an outlet, and a fuel injector cup associated with the fuel rail outlet. The fuel injector cup includes a cup portion and a ring portion. The cup portion comprises a body, and the body includes a base at a first end, an opening at a second end, and an inner cavity therein between the base and the opening. The cavity of the cup portion is configured to receive a fuel injector, and the first end of the cup portion is configured to be associated with the outlet of the fuel rail. The ring portion of the fuel injector cup is configured to be affixed to the cup portion, and the second end thereof, in particular. The ring portion is further configured to reinforce the second end of said cup portion.

28 Claims, 3 Drawing Sheets

TWO-PIECE INJECTOR CUP AND METHOD OF MANUFACTURING SAME

CROSS REFERENCE TO RELATED APPLICATIONS

This application claims the benefit of U.S. Provisional Application Ser. No. 61/020,834 entitled "Two-Piece Injector Cup," which was filed on Jan. 14, 2008, and which is hereby incorporated by reference in its entirety.

FIELD OF THE INVENTION

The field of the present invention is fuel delivery systems. More particularly, the present invention relates to an injector cup for use in fuel delivery systems, such as, for example, gasoline direct injection systems, and a method of manufacturing the same.

BACKGROUND OF THE INVENTION

Fuel delivery systems for direct injection and port injection applications, such as, for example, fuel-injected engines used in various types of on-road and off-road vehicles, typically include one or more fuel rails having a plurality of fuel injectors associated therewith. In such applications, the fuel rails include a plurality of outlet openings in which injector sockets or cups are affixed. The fuel injectors are inserted into and coupled with the injector cups so as to allow for the fuel flowing in the fuel rail to be communicated to the fuel injectors. The fuel communicated from the fuel rail to the fuel injectors is then communicated to the combustion chamber of the engine. Accordingly, in these arrangements the fuel injectors are sandwiched between the fuel rail and a corresponding cylinder head of the engine.

Conventional fuel injector cups generally take one of two forms. The first is normally used in low-pressure port fuel injection applications. This type of injector cup is typically stamped and includes a flange or ears that act as an attachment for retention clips that are used to retain the fuel injector within the fuel injector cup. The second is normally used in high-pressure direct injection applications. This type of injector cup is typically cast or forged and then subjected to secondary machining processes to create precise sealing surfaces for injector o-rings, as well as internal and/or external features for mating with the injector clip, for example.

Cast or forged cups, as opposed to stamped cups, are utilized in direct injection applications due to the force generated by the relatively high amount of pressure (i.e., on the order of 10-20 MPa or more) that is applied to the injector/injector clip/fuel injector cup interface in such systems. One drawback of cast/forged cups is that secondary machining processes or operations have to be performed on the cup to create the necessary surfaces and/or features required to allow for the sealing of the system and the retention of the injector within the cup. This secondary machining results in additional manufacturing steps, and therefore, complexity and cost, being added to the manufacturing process.

Therefore, there is a need for a fuel delivery system that will minimize and/or eliminate one or more of the above-identified deficiencies.

SUMMARY OF THE INVENTION

The present invention is directed to a fuel delivery system. The fuel delivery system comprises a fuel rail having an outlet, and a fuel injector cup associated therewith. The fuel injector cup includes a first portion and a ring portion.

The first portion of the fuel injector cup comprises a body. The body includes a first end, a second end, and a cavity therein between the first and second ends. The cavity of the body is configured to receive a fuel injector, and the first end of the body is configured to be associated with the outlet of the fuel rail.

The ring portion of the fuel injector cup is configured to be affixed to the first portion, and the second end thereof, in particular. The ring portion is further configured to reinforce the second end of the first portion.

Further features and advantages of the present invention, including the constituent components and methods of manufacturing the same, will become more apparent to those skilled in the art after a review of the invention as it is shown in the accompanying drawings and detailed description.

DETAILED DESCRIPTION OF PREFERRED EMBODIMENTS

Figure 1:
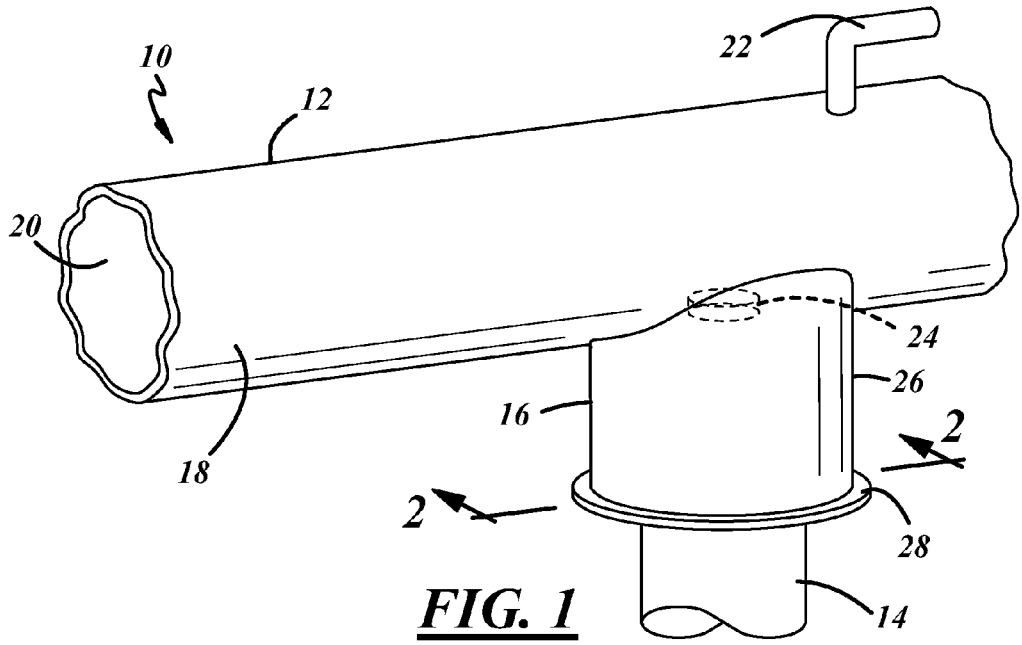
FIG. 1 is a perspective view of a fuel delivery system in accordance with the present invention.

The present invention is directed, at least in part, to a fuel delivery system having a fuel injector cup comprising a stamped cup portion that is augmented with a ring portion to provide the stamped cup the strength and structural integrity typically found in cast or forged fuel injector cups to withstand the forces generated by the fuel delivery system having a system pressure on the order of 10-20 MPa or more. Accordingly, referring now to the drawings wherein like reference numerals are used to identify identical components in the various views, FIG. 1 illustrates one exemplary embodiment of such a fuel delivery system 10. Fuel delivery system 10 generally includes a fuel rail 12, a fuel injector 14, and a fuel injector cup 16.

With continued reference to FIG. 1, fuel rail 12 comprises a hollow body 18 defining a flow channel 20 therein. Fuel rail 12 further comprises an inlet 22 in hollow body 18 in fluid communication with flow channel 20, and one or more outlet openings 24 in body 18 that, as will be described more fully below, are associated with respective injector cups 16 and that are also in fluid communication with flow channel 20. Inlet 22 is configured to be coupled to a fuel source or supply, such as, for example, the fuel tank of a vehicle, and flow channel 20 is configured to allow for the communication of fuel between inlet 22 and outlet opening 24. As will be described in greater detail below, outlet opening 24 is configured to communicate fuel in flow channel 20 to injector 14. Fuel rail 12 may be formed of any number of materials, such as, for example, metal (i.e., aluminum, stainless steel, etc.), thermoplastics, or a combination of the two.

Figure 2A:
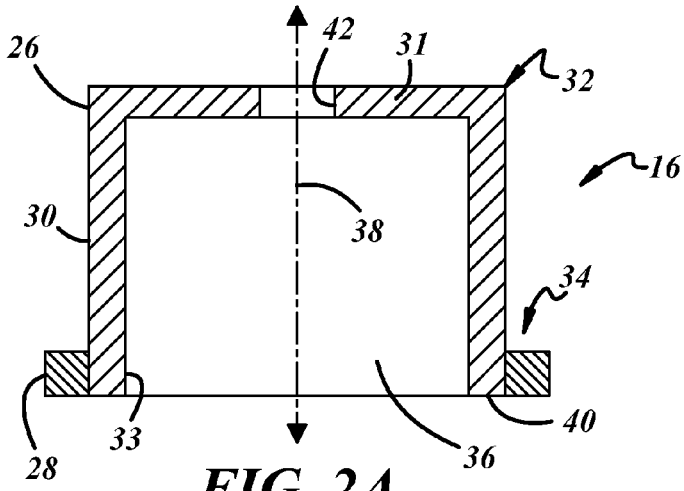
FIGS. 2*a* and 2*b* are exaggerated cross-sectional views of an exemplary embodiment of the fuel injector cup illustrated in FIG. 1 taken along the lines 2-2 in FIG. 1.
Figure 2B:
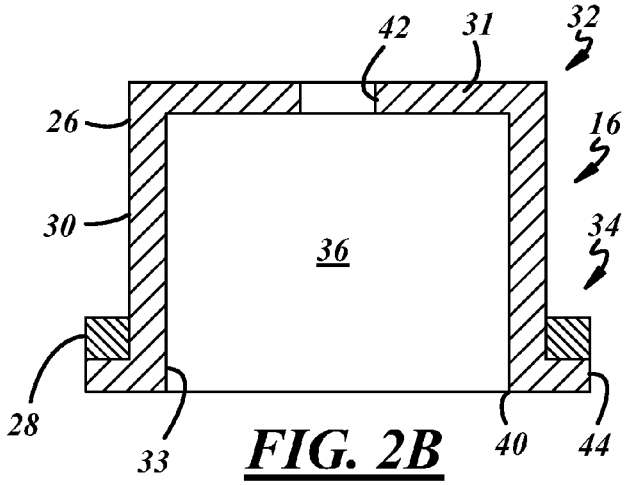

With reference to FIGS. 2*a*-2*b*, for example, fuel injector cup 16 will be described. Injector cup 16 includes a first or cup portion 26 and a second or ring portion 28. In an exemplary embodiment, cup portion 26 includes a cylindrically-shaped body 30 having a base 31 disposed at a first end 32, an opening 33 disposed at a second end 34, and an inner cavity 36 therein between base 31 and opening 33. Cup portion 26 further defines a longitudinal axis 38 extending longitudinally between first end 32 and second end 34. Opening 33 provides access into cavity 36 and is defined by an edge 40 of body 30. Cavity 36 is configured to receive a portion of fuel injector 14, including the inlet thereof. First end 32 of cup portion 26 is configured to be associated with fuel rail outlet 24. In an exemplary embodiment, first end 32 is affixed to fuel rail 12 proximate outlet opening 24 using conventional methods, such as, for example, welding or brazing. In another exemplary embodiment, however, cup portion 26 may be indirectly coupled to fuel rail 12 using an connector that is affixed to both cup portion 26 and fuel rail 12, or a portion thereof may be integrally or unitarily formed with fuel rail 12.

As illustrated in FIGS. 2*a* and 2*b*, for example, cup portion 26 further includes a passageway 42 disposed in body 30 that is configured to be in fluid communication with outlet opening 24 of fuel rail 12 when cup portion 26 is assembled with fuel rail 12. As such, fuel in flow channel 20 can flow through outlet opening 24, passageway 42, and into cavity 36 in which the inlet of fuel injector 14 is disposed. When cup 16 and fuel rail 12 are assembled, passageway 42 may be substantially aligned with outlet opening 24, or, in an alternate exemplary embodiment, may be offset therefrom. Additionally, in an exemplary embodiment, passageway 42 is disposed in body 30 at or near first end 32. For example, FIGS. 2*a* and 2*b* illustrate passageway 42 being disposed in base 31. However, in another embodiment, passageway 42 is disposed in body 30 anywhere between first and second ends 32, 34 (i.e., in the side of body 30). Accordingly, the present invention is not meant to be limited to the illustrated embodiment. Rather, in alternate exemplary embodiments passageway 42 may be disposed anywhere in body 30 between first end 32 and second 34. As will be described in greater detail below, in an exemplary embodiment cup portion 26 may further include a flange 44 (best shown in FIG. 2*b*) disposed at second end 34 of body 30 proximate opening 33 and edge 40. Flange 44 may be a continuous flange extending around the entire circumference of body 30, or may comprise a plurality of individual flanges disposed at various locations around the circumference.

Turning now ring portion 28 of injector cup 16, ring portion 28 (also referred to herein as ring 28) is configured to be affixed to cup portion 26, and second end 34 thereof, in particular. When affixed to cup portion 26, ring portion 28 is operative to, at least in part, reinforce second end 34 of cup portion 26 to avoid damage or destruction thereto caused by the force applied to injector 14 and cup 16 as a result of the pressure attendant in the system, which can be on the order of 10-20 MPa or more. More particularly, the pressure in fuel delivery system 10 generates a force that is applied to the fuel injector causing the injector to want to "pop" out of the injector cup. A fuel injector clip is coupled to or mated with both the fuel injector and the injector cup to retain the fuel injector in the injector cup and to counteract the force. Accordingly, the force applied to the injector is transferred to the clip, and from the clip to the cup to which the clip is coupled/mated. As a result, the portion of the cup mated or coupled with the injector clip (i.e., second end 34) must have sufficient strength and structural integrity to bear this force. Ring portion 28 provides this added strength and structural integrity to cup portion 26.

Figure 3:
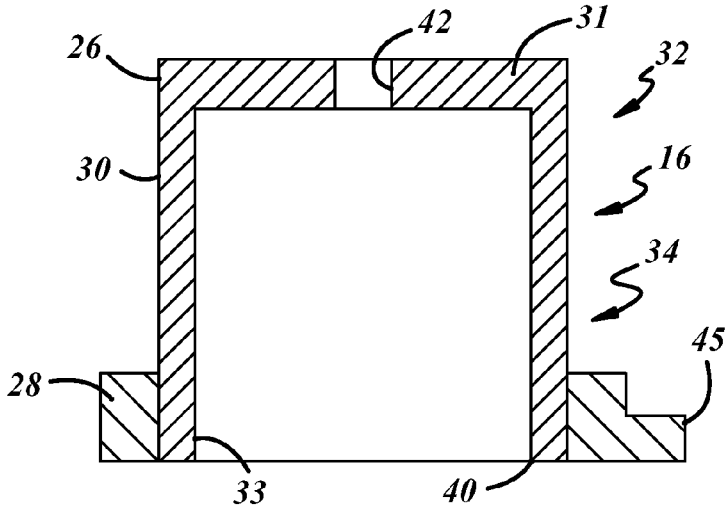
FIG. 3 is an exaggerated cross-sectional view of another exemplary embodiment of the fuel injector cup illustrated in FIGS. 1, 2*a*, and 2*b*.

In addition to providing reinforcement to cup portion 26, in an exemplary embodiment illustrated, for example, in FIG. 3, ring 28 may also provide one or more injector orientation features 45 configured and operative to allow for functions such as, for exemplary purposes only, the clocking of injector 14, the anti-rotation of injector 14, or other similar functions to be performed. Orientation feature 45 may be unitarily formed with ring 28 or, alternatively, may be a separate and distinct component that is affixed to or otherwise coupled with ring 28. Accordingly, while the description herein is primarily directed to an embodiment wherein cup portion 26 is a stamped cup and ring 28 provides reinforcement for cup portion 26, the present invention is not meant to be so limited. Rather, certain aspects of the present invention, such as, for example, ring 28 having fuel injector orientation features, are applicable to cup portions 26 formed using stamped, cast, forged, or machined processes.

With reference to FIGS. 2*a* and 2*b*, in an exemplary embodiment, ring portion 28 comprises an annular ring. In this embodiment, when cup portion 26 and ring 28 are assembled, ring 28 is disposed at, and circumscribes, second end 34. Once positioned, ring 28 is affixed to cup portion 26 using known processes/techniques, such as, for example, welding or brazing processes. In an exemplary embodiment wherein cup portion 26 includes flange 44, ring 28 is assembled with cup portion 26 such that ring 28 abuts flange 44, as illustrated in FIG. 2*b*, and is then affixed to cup portion 26. In an exemplary embodiment, ring 28 is constructed of the same material as cup portion 26 to facilitate brazing or welding of the two portions together. In an exemplary embodiment, ring portion 28 is formed of stainless steel. Additionally, depending on how cup portion 26 is constructed and for what purpose ring portion 28 is intended (e.g., fuel injector orientation, added reinforcing strength, etc.), ring portion 28 may have any number of thicknesses. For instance, in an exemplary embodiment wherein cup portion 26 is stamped and has a wall thickness of 1-2 mm, for example, ring portion 28 may have a thickness of 1-3 mm, for example. Alternatively, rather than being stamped, in an exemplary embodiment, cup portion 26 may be forged. In such an embodiment, cup portion 26 may have a wall thickness of 2-4 mm, and ring portion 28 may have a thickness of 1-2 mm. Accordingly, the thickness of ring portion 28 depends on the thickness of the wall of cup portion 26 and/or the intended function of the ring, whether for fuel injector orientation, fuel injector clocking, anti-rotation, or strength, for example.

Figure 4A:
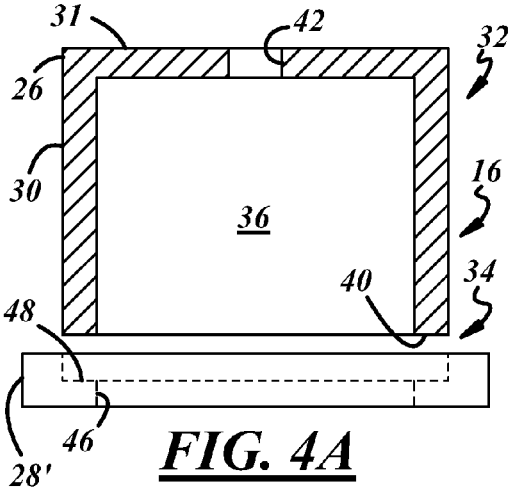
FIGS. 4*a* and 4*b* are exaggerated partial cross-sectional views of another exemplary embodiment of the fuel injector cup illustrated in FIGS. 2*a* and 2*b*, with FIG. 4*a* illustrating the fuel injector cup in an unassembled state, and FIG. 4*b* illustrating the fuel injector cup in an assembled state.
Figure 4B:
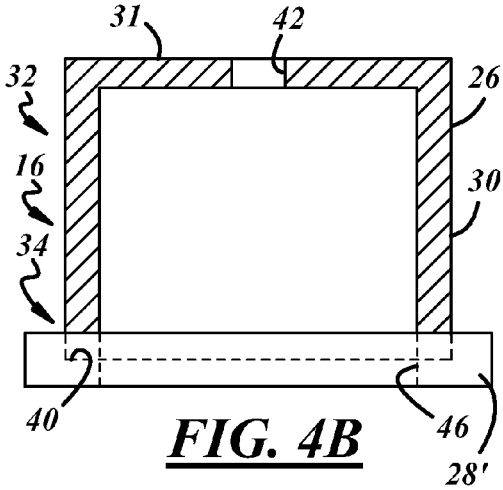

With reference to FIGS. 4*a* and 4*b*, another exemplary embodiment of ring portion 28 (Ring portion 28' or ring 28') is illustrated. FIG. 4*a* illustrates an exemplary embodiment of fuel injector cup 16 in an unassembled state, while FIG. 4*b* illustrates fuel injector cup 16 in an assembled state. In this embodiment, ring portion 28' comprises a cap. Unlike the embodiment wherein ring portion 28 comprises an annular ring which only surrounds the outer surface of cup portion 26, in this embodiment, ring 28' is configured to be fitted over second end 34 such that it surrounds the outer surface of cup portion 26 and also covers edge 40 thereof. Ring portion 28' includes an aperture 46 therein configured to allow for insertion of injector 14 into cavity 36 when ring portion 28' is assembled with cup portion 26. In an exemplary embodiment best shown in FIGS. 6*a* and 6*b*, ring portion 28' may further include a shoulder 48 on the interior surface thereof. As illustrated in FIG. 6*b*, shoulder 48 is configured to abut edge 40 when ring portion 28' is assembled with cup portion 26. Once ring portion 28' is positioned, it is affixed to cup portion 26 using known processes/techniques, such as, for example, welding or brazing processes.

With reference to FIGS. 5*a*-6*b*, in an exemplary embodiment, one or both of cup portion 26 and ring portion 28 of injector cup 16 include one or more notches 50 therein. Notches 50 are configured to receive a portion of a fuel injector retention clip 52, or other retention feature, used to retain fuel injector 14 within injector cup 16.

Figure 5A:
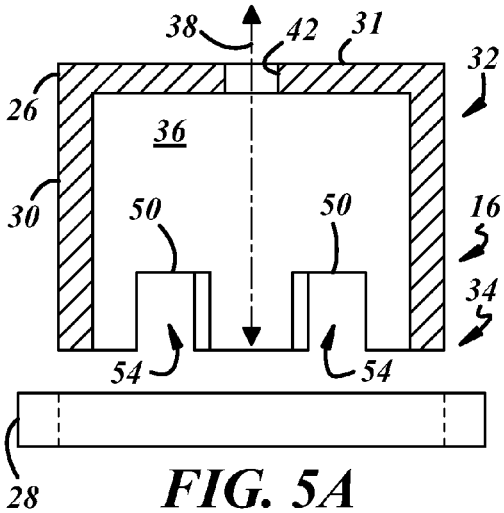
FIGS. 5*a* and 5*b* are exaggerated partial cross-sectional views of an alternate exemplary embodiment of the fuel injector cups illustrated in FIGS. 2*a*-3*b*, with FIG. 5*a* illustrating the fuel injector cup in an unassembled state, and FIG. 5*b* illustrating the fuel injector cup in an assembled state.
Figure 5B:
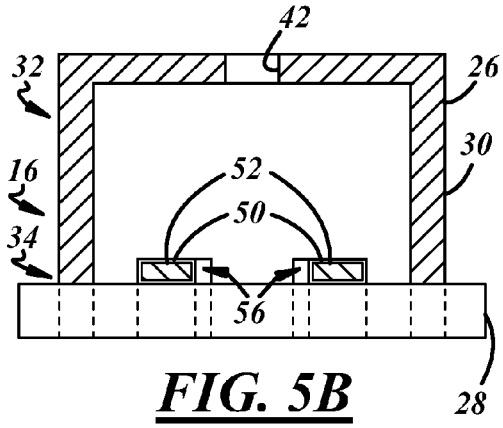

In an exemplary embodiment, cup portion 26 and/or ring portion 28 include a plurality of notches 50 therein. FIGS. 5*a* and 5*b* illustrate an exemplary embodiment wherein cup portion 26 includes a plurality of notches 50 disposed in body 30 at second end 34 thereof. FIG. 5*a* illustrates an exemplary embodiment of fuel injector cup 16 in an unassembled state, while FIG. 5*b* illustrates fuel injector cup 16 in an assembled state. It should be noted that while FIGS. 5*a* and 5*b* depict a two-notch arrangement, the present invention is not meant to be limited to such an arrangement. Rather, arrangements having fewer or more notches remain within the spirit and scope of the present invention. As illustrated in FIG. 5*a*, each notch 50 has an opening 54 located at edge 40 and extends a predetermined longitudinal distance relative to axis 38 toward first end 32. As illustrated in FIG. 5*b*, when ring portion 28 is affixed to cup portion 26, ring portion 28, which may take the form of an annular ring or cap, as described above, or any other suitable component, overlaps a portion of each notch 50, including notch opening 54. Accordingly, when cup portion 26 and ring portion 28 are assembled, ring portion 28 closes access to notch or notches 50, effectively creating a number of windows 56 in cup portion 26 equal to the number of notches 50. The partial closing of the notches and the creation of the windows allows for portions of fuel injector clip 52 to be "captured" and retained therein.

Figure 6A:
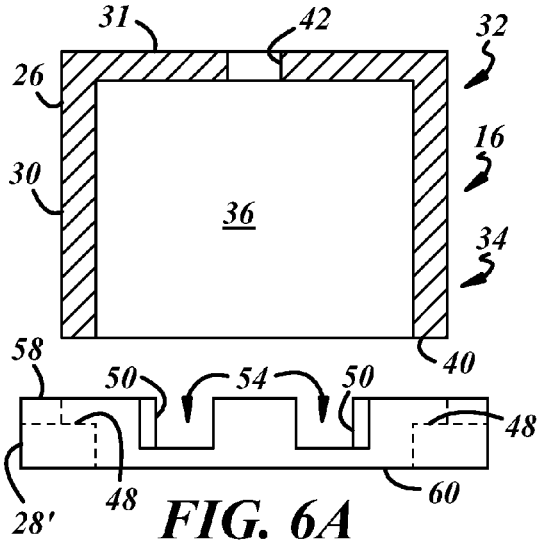
FIGS. 6*a* and 6*b* are exaggerated partial cross-sectional views of an alternate exemplary embodiment of the fuel injector cups illustrated in FIGS. 2*a*-4*b*, with FIG. 6*a* illustrating the fuel injector cup in an unassembled state, and FIG. 6*b* illustrating the fuel injector cup in an assembled state.
Figure 6B:
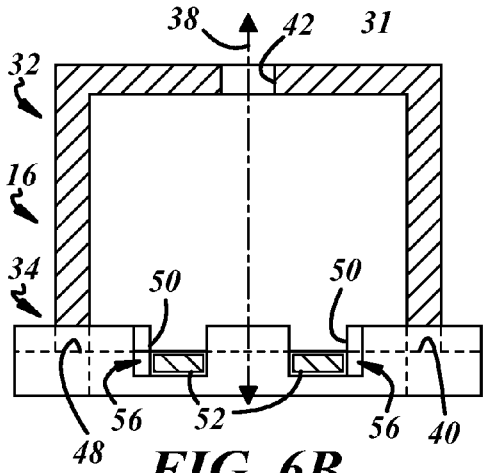

FIGS. 6*a* and 6*b* illustrate an alternate exemplary embodiment wherein ring portion 28' includes a plurality of notches 50 disposed therein. FIG. 6*a* illustrates fuel injector cup 16 in an unassembled state, while FIG. 6*b* illustrates fuel injector cup 16 in an assembled state. It should be noted that while FIGS. 6*a* and 6*b* depict a two-notch arrangement, the present invention is not meant to be limited to such an arrangement. Rather, arrangements having fewer or more notches remain within the spirit and scope of the present invention. In this embodiment, ring portion 28' takes the form of a cap, as described above. As shown in FIG. 6*a*, ring portion 28' includes a first side 58 and a second side 60. When assembled with cup portion 26, first side 58 faces base 31 of cup portion 26, while second side 60 faces away from cup portion 26. As illustrated in FIG. 6*a*, each notch 50 has an opening 54 disposed in first side 58 and extends a predetermined longitudinal distance toward second side 60. As illustrated in FIG. 6*b*, when ring portion 28' is affixed to cup portion 26, shoulder 48 of ring portion 28' engages and abuts edge 40 of cup portion 26 such that notches 50 are not completely closed by or overlapping cup portion 26. Accordingly, shoulder 48 acts to limit how far onto cup portion 26 ring portion 28' is positioned. However, shoulder 48 is sized such that when ring portion 28' is fitted over second end 34 of cup portion 26, first side 58 of ring portion 28' sufficiently overlaps the outer surface of cup portion 26 such that access to each notch 50 is closed by cup portion 26, thereby effectively creating a number of windows 56 in ring portion 28' equal to the number of notches 50. The partial closing of the notches and the creation of the windows allows for portions of fuel injector clip 52 to be "captured" and retained therein.

Figure 7:
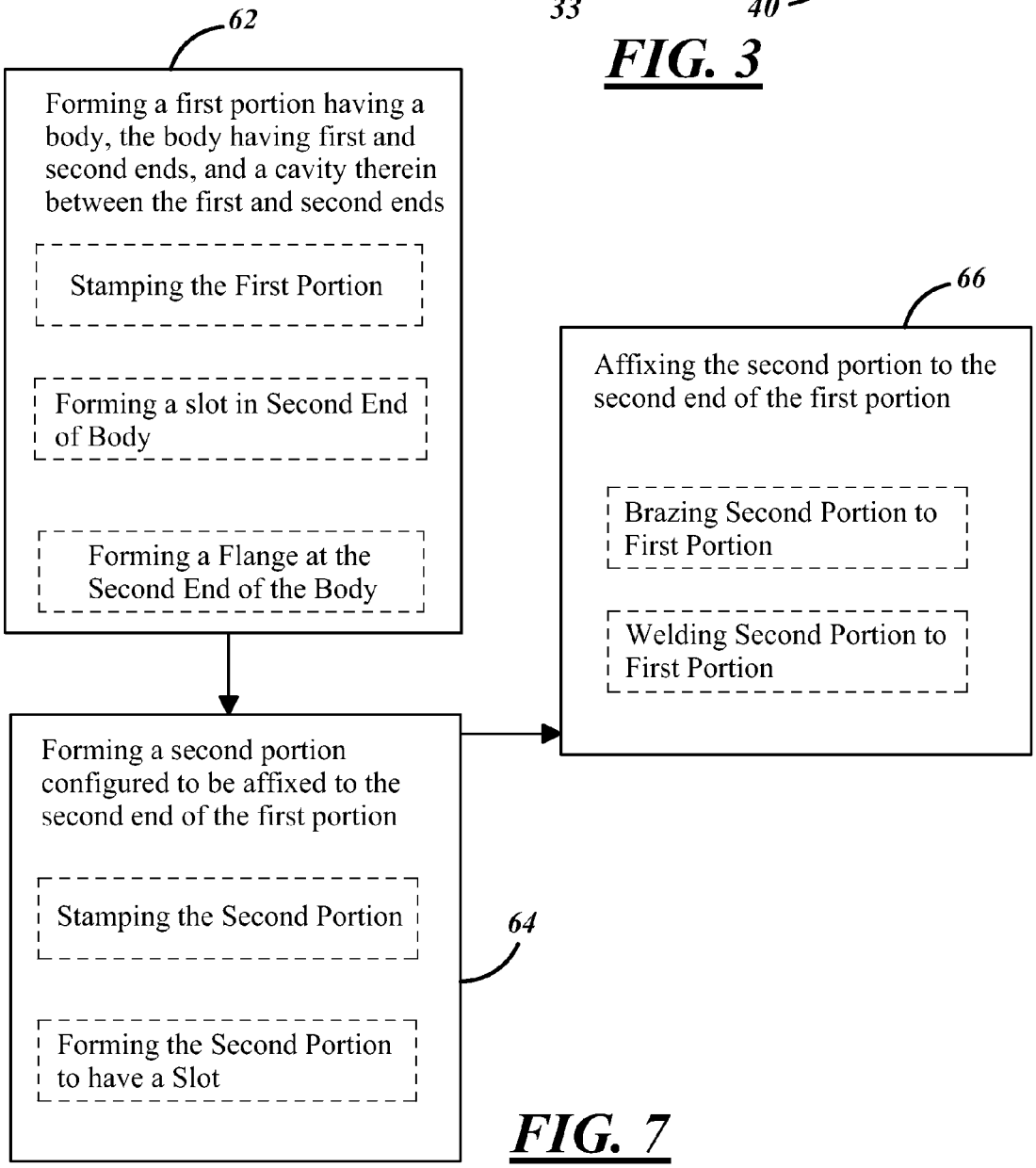
FIG. 7 is a flow diagram of an exemplary embodiment of a method of manufacturing a fuel injector cup in accordance with the present invention.

The foregoing having described exemplary embodiments of fuel system 10 and fuel injector cup 16, in particular, an exemplary method of manufacturing injector cup 16 will be described with reference to FIG. 7.

In a first step 62, cup portion 26 is formed. As set forth in greater detail above, cup portion 26 includes body 30 having first end 32, second end 34, and inner cavity 36 disposed therein between first end 32 and second end 34. In an exemplary embodiment, step 62 includes stamping cup portion 26. In such an embodiment, the stamping process includes creating sealing surfaces and retention features on or in cup portion 26. Cups typically used in high pressure applications, such as direct injection applications, are usually cast or forged to provide the cup the necessary strength and structural integrity to withstand the forces applied to the cup in the system. As such, the surfaces and features have to be machined onto injector cups in secondary post-forging/casting machining steps.

In an exemplary embodiment, forming step 62 further includes forming cup portion 26 to include at least one notch 50 in body 30 thereof. More particularly, one or more notches 50 are formed in body 30 at second end 34. Notch 50 may be formed by employing a number of processes or techniques, such as, for example, a piercing operation. Forming step 62 may further include forming cup portion 26 to include a flange 44 disposed at second end 34 thereof. In an embodiment wherein cup portion 26 includes one or more notches 50 therein and a flange 44 is desired, cup portion 26 may be formed by forming notches 50 in body 30 and then manipulating a portion of second end 34 of body 30 to create flange 44. This manipulation may include, for exemplary purposes only, rolling or folding edge 40 over to a 90 degree angle with the remainder of body 30.

In a second step 64, ring portion 28 is formed wherein ring portion 28 is configured to be affixed to cup portion 26. In an exemplary embodiment, ring portion 28 is formed to comprise an annular ring. However, in an alternate embodiment, ring portion 28 is formed to comprise a cap configured to be fitted over cup portion 26, and second end 34 thereof, in particular. In such an embodiment, ring portion 28 may be formed to include shoulder 48 on the interior surface thereof that is configured to engage and abut outer edge 40 of cup portion 26. In an exemplary embodiment, forming step 64 includes stamping ring portion 28. In other exemplary embodiments, ring portion 28 may be formed using other known processes, such as, for example, casting, forging, or other like processes. Forming step 64 may further include forming ring portion 28 to include at least one notch 50 therein. Notches 50 may be formed by employing a number of processes or techniques, such as, for example, a piercing operation.

In a third step 66, ring portion 28 is affixed to cup portion 26. In an exemplary embodiment, affixing step 66 includes positioning ring portion 28 at second end 34 of cup portion 26 such that at least part of ring portion 28 overlaps part of cup portion 26. Ring portion 28 is then affixed to cup portion 26 using any number of known processes/techniques, such as, for exemplary purposes only, welding or brazing operations. In embodiment wherein cup portion 26 includes a flange 40, affixing step 66 includes positioning ring portion 28 such that it abuts flange 44, and then affixing ring portion 28 to cup portion 26. Further, in an embodiment wherein cup portion 26 includes one or more notches 50, affixing step 66 includes positioning ring portion 28 such that it overlaps part of notches 50 and effectively closes access to notches 50, thereby creating a number of windows 56 in cup portion 26 equal to the number of notches 50. Similarly, in an embodiment wherein ring portion 28' includes one or more notches 50, affixing step 66 includes positioning ring portion 28' over second end 34 of cup portion 26 such that a part of each notch 50 in ring portion 28' overlaps part of cup portion 26, effectively closing access to each notch 50, thereby creating a number of windows 56 in ring portion 28' equal to the number of notches 50.

While the invention has been particularly shown and described with reference to the preferred embodiments thereof, it is well understood by those skilled in the art that various changes and modifications can be made in the invention without departing from the spirit and scope of the invention.

The invention claimed is:

1. A fuel delivery system, comprising:

a fuel rail having an outlet; and a fuel injector cup configured to be associated with said outlet of said fuel rail, wherein said fuel injector cup includes:

a cup portion having body, said body having a base at a first end, an opening at a second end, and an inner cavity therein between said base and said opening, said cavity configured to receive a fuel injector and said first end configured to be associated with said outlet of said fuel rail; and a ring portion configured to be affixed to said second end of said cup portion and further configured to reinforce said second end of said cup portion.

2. A fuel delivery system in accordance with claim 1 wherein one of said cup portion and said ring portion includes at least one window therein providing access to said inner cavity in said cup portion.

3. A fuel delivery system in accordance with claim 1 wherein said body of said cup portion further includes at least one notch therein at said second end configured for receiving a portion of a fuel injector retention clip, said notch including a notch opening and wherein said access to said notch through said notch opening is closed by said ring portion when said ring portion is affixed to said cup portion thereby forming a window therein.

4. A fuel delivery system in accordance with claim 1 wherein said ring portion of said fuel injector cup includes at least one notch therein configured for receiving a portion of a fuel injector retention clip, said notch having a notch opening facing said cup portion, wherein access to said notch through said notch opening is closed by said cup portion when said ring portion is affixed to said cup portion thereby forming a window therein.

5. A fuel delivery system in accordance with claim 1 wherein said ring portion comprises an annular ring circumscribing said second end of said cup portion.

6. A fuel delivery system in accordance with claim 1 wherein said body of said cup portion includes an annular flange at said second end thereof, said flange configured to abut said ring portion when said ring portion is affixed to said cup portion.

7. A fuel delivery system in accordance with claim 1 wherein said ring portion comprises a cap configured to be fitted over said second end of said cup portion.

8. A fuel delivery system in accordance with claim 1 wherein said ring further includes a fuel injector orientation feature.

9. A fuel injector cup for use in a fuel delivery system, comprising:

a cup portion having body, said body having a base at a first end, an opening at a second end, and an inner cavity therein between said base and said opening, said cavity configured to receive a fuel injector, and said first end configured to be associated with said outlet of a fuel rail; and a ring portion configured to be affixed to said second end of said cup portion and further configured to reinforce said second end of said cup portion.

10. A fuel injector cup in accordance with claim 9 wherein said body of said cup portion further includes at least one notch therein at said second end configured for receiving a portion of a fuel injector retention clip, said notch including a notch opening and wherein access to said notch through said notch opening is closed by said ring portion when said ring portion is affixed to said cup portion thereby forming a window therein.

11. A fuel injector cup in accordance with claim 9 wherein said ring portion of said fuel injector cup includes at least one notch therein, said at least one notch configured for receiving a portion of a fuel injector retention clip, said notch having a notch opening facing said cup portion, wherein access to said notch through said notch opening is closed by said cup portion when said ring portion is affixed to said cup portion thereby forming a window therein.

12. A fuel injector cup in accordance with claim 9 wherein said ring portion comprises an annular ring circumscribing said second end of said cup portion.

13. A fuel injector cup in accordance with claim 9 wherein said body of said cup portion includes an annular flange at said second end thereof, said flange configured to abut said ring portion when said ring portion is affixed to said cup portion.

14. A fuel delivery system in accordance with claim 9 wherein said ring portion comprises a cap configured to be fitted over said second end of said cup portion.

15. A fuel injector cup in accordance with claim 9 wherein said ring portion includes a fuel injector orientation feature.

16. A method of manufacturing a fuel injector cup, said method comprising the steps of:

forming a cup portion having body, said body having a base at a first end, an opening at a second end, and an inner cavity therein between said base and said opening, said inner cavity configured to receive a fuel injector, and said first end configured to be associated with an outlet of a fuel rail;

forming a ring portion configured to be affixed to said second end of said cup portion; and affixing said ring portion to said second end of said cup portion.

17. A method in accordance with claim 16 wherein said forming a cup portion step comprises stamping said cup portion, and said forming a ring portion step comprises stamping said ring portion.

18. A method in accordance with claim 16 wherein said forming a cup portion step includes forming said cup portion to include a notch in said body at said second end thereof.

19. A method in accordance with claim 18 wherein said forming a cup portion step includes the substep of piercing said cup portion to include said notch in said body at said second end thereof.

20. A method in accordance with claim 19 wherein said forming cup step further includes the substep of creating a flange at the second end of said body.

21. A method in accordance with claim 16 wherein said forming a ring portion step includes forming said ring portion to include a notch therein.

22. A method in accordance with claim 21 wherein said forming a ring portion step includes the substep of piercing said ring portion to include said notch therein.

23. A method in accordance with claim 16 wherein said forming a ring portion step comprises forming a ring.

24. A method in accordance with claim 16 wherein said forming a ring portion step comprises forming cap.

25. A method in accordance with claim 16 wherein said affixing step comprises brazing said ring portion to said cup portion.

26. A method in accordance with claim 16 wherein said affixing step comprises welding said ring portion to said cup portion.

27. A method in accordance with claim 16 wherein:

said forming a cup portion step includes forming said cup portion to have a flange disposed at the second end thereof; and said affixing step includes the substep of abutting said ring portion against said flange before affixing said ring portion to said cup portion.

28. A method in accordance with claim 16 wherein one of said forming a cup portion and forming a ring portion steps includes forming said cup portion or said ring portion to have a window therein providing access to said cavity in said cup portion.

* * * * *